US011522325B2

(12) United States Patent
Li

(10) Patent No.: US 11,522,325 B2
(45) Date of Patent: Dec. 6, 2022

(54) SAFETY PLUG AND AN ELECTRIC EQUIPMENT

(71) Applicant: Xiamen Longstar Lighting Co., Ltd., Fujian (CN)

(72) Inventor: Xilong Li, Fujian (CN)

(73) Assignee: Xiamen Longstar Lighting Co., Ltd., Xiamen (CN)

( * ) Notice: Subject to any disclaimer, the term of this patent is extended or adjusted under 35 U.S.C. 154(b) by 29 days.

(21) Appl. No.: 17/358,075

(22) Filed: Jun. 25, 2021

(65) Prior Publication Data

US 2022/0115827 A1 Apr. 14, 2022

(30) Foreign Application Priority Data

Oct. 14, 2020 (CN) ..... 202022286713.2

(51) Int. Cl.
*H01R 24/70* (2011.01)
*H01R 13/648* (2006.01)
*H01R 103/00* (2006.01)

(52) U.S. Cl.
CPC ..... *H01R 24/70* (2013.01); *H01R 13/6485* (2013.01); *H01R 2103/00* (2013.01)

(58) Field of Classification Search
CPC .. H01R 13/7033; H01R 13/713; H01R 13/44; H01R 24/70; H01R 13/6485; H01R 2103/00
See application file for complete search history.

(56) References Cited

U.S. PATENT DOCUMENTS 9,059,550 B2 * 6/2015 Beak ..... H01R 24/70
2017/0012392 A1 * 1/2017 Kot ..... H01R 13/633
2020/0144763 A1 * 5/2020 Lee ..... H01R 33/965

* cited by examiner

*Primary Examiner* — Oscar C Jimenez
*Assistant Examiner* — Paul D Baillargeon
(74) *Attorney, Agent, or Firm* — Cooper Legal Group, LLC

(57) ABSTRACT

The present disclosure discloses a safety plug comprising two pins, an insulating housing, a limiting member, and an operating member. The operating member is configured to drive the limiting member to be changed between a position-limited position and an unlocked position. First ends of the two pins extend into the insulating housing, a short-circuit protection circuit is disposed in the insulating housing, and the short-circuit protection circuit is disposed in a path in which the two pins move away from the insulating housing. When the limiting member is in the position-limited position, a limiting fit is defined, and the first ends of the two pins are spaced apart from the short-circuit protection circuit. When the limiting member is in the unlocked position, the limiting fit is released, and the insulating housing is pulled to enable the short-circuit protection circuit to short circuit the two pins.

17 Claims, 5 Drawing Sheets

SAFETY PLUG AND AN ELECTRIC EQUIPMENT

RELATED APPLICATIONS

This application claims priority to Chinese patent application number 202022286713.2, filed on Oct. 14, 2020. Chinese patent application number 202022286713.2 is incorporated herein by reference.

FIELD OF THE DISCLOSURE

The present disclosure relates to electrical equipment, and in particular to a plug.

BACKGROUND OF THE DISCLOSURE

At present, the energization of electrical equipment has a plugging step of directly inserting a plug into a power supply hole of a power supply socket to electrically connect the electrical equipment to a power supply. The power supply socket is connected to a power supply source and will remain energized. Although this plugging step is easy to perform, manually inserting the plug into the power supply hole may generate an electric arc, which may cause an electric shock. In addition, when the electrical equipment is not in use, the plug is often pulled out from the power supply hole, which will cause the power supply hole to be exposed. When a child inserts his/her finger or a metal rod directly into the power supply hole of the power supply socket, it will cause an electric shock accident and even endanger the child's life, which is a great potential risk. Further, when the plug is manually pulled out, not only is a large force needed, but also an electric arc may be generated, which may cause an electric shock.

BRIEF SUMMARY OF THE DISCLOSURE

The present disclosure provides a safety plug to avoid electric shock accidents when a user unplugs the safety plug.

In order to solve the technical problem, a first technical solution of the present disclosure is as follows.

A safety plug comprises two pins, an insulating housing, a limiting member, and an operating member. The operating member is configured to drive the limiting member to be changed between a position-limited position and an unlocked position. When the limiting member is in the position-limited position, movement of the two pins and the limiting member is limited in an axial direction of the two pins to define a limiting fit. When the limiting member is in the unlocked position, the limiting fit is released to enable the two pins and the limiting member to move along the axial direction of the two pins. First ends of the two pins extend into the insulating housing. A short-circuit protection circuit is disposed in the insulating housing, and the short-circuit protection circuit is disposed in a path in which the two pins move away from the insulating housing. When the limiting fit is defined, the first ends of the two pins are spaced apart from the short-circuit protection circuit. When the limiting fit is released, the insulating housing is pulled to enable the insulating housing to move relative to the two pins to enable the short-circuit protection circuit to short circuit the two pins.

In a preferred embodiment, the operating member is disposed on both sides of the insulating housing in a width direction of the insulating housing and passes through side walls of the insulating housing to be operatively coupled to the limiting member.

In a preferred embodiment, the limiting member comprises a linkage bar, which is disposed along the width direction of the insulating housing. Two ends of the linkage bar are respectively operatively coupled to the operating member.

In a preferred embodiment, the limiting member comprises two groups of first protruding surfaces disposed on two side walls spaced apart from each other along a thickness direction of the linkage bar. Each of the two groups of first protruding surfaces comprises two first protruding surfaces, and the two first protruding surfaces are spaced apart from each other to define a space-providing passage.

In a preferred embodiment, a part of each of the two pins that is disposed in the insulating housing defines a second protruding surface extending along a thickness direction of the two pins. When the limiting member is in the position-limited position, the two first protruding surfaces abut the second protruding surface along the axial direction of the two pins to define a limiting connection.

In a preferred embodiment, distal ends of the parts of the two pins that are disposed in the insulating housing extend opposite to each other to define a blocking wall. When the two pins move relative to the insulating housing, the blocking wall is electrically connected to the short-circuit protection circuit.

In a preferred embodiment, an output adapter board is disposed in the insulating housing. When the limiting member is in the position-limited position, the blocking wall is electrically connected to the output adapter board.

In a preferred embodiment, when the blocking wall is electrically connected to the short-circuit protection circuit, the blocking wall is insulated and isolated from the output adapter board.

A second technical solution of the present disclosure is as follows.

An electrical equipment comprises an electrical equipment body, and a safety plug. The safety plug comprises two pins, an insulating housing, a limiting member, and an operating member. The operating member is configured to drive the limiting member to be changed between a position-limited position and an unlocked position. When the limiting member is in the position-limited position, movement of the two pins and the limiting member is limited in an axial direction of the two pins to define a limiting fit. When the limiting member is in the unlocked position, the limiting fit is released to enable the two pins and the limiting member to move along the axial direction of the two pins. First ends of the two pins extend into the insulating housing. A short-circuit protection circuit is disposed in the insulating housing, and the short-circuit protection circuit is disposed in a path in which the two pins move away from the insulating housing. When the limiting fit is defined, the first ends of the two pins are spaced apart from the short-circuit protection circuit. When the limiting fit is released, the insulating housing is pulled to enable the insulating housing to move relative to the two pins to enable the short-circuit protection circuit to short circuit the two pins.

In a preferred embodiment, the operating member is disposed on both sides of the insulating housing in a width direction of the insulating housing and passes through side walls of the insulating housing to be operatively coupled to the limiting member.

In a preferred embodiment, the limiting member comprises a linkage bar, which is disposed along the width direction of the insulating housing. Two ends of the linkage bar are respectively operatively coupled to the operating member.

In a preferred embodiment, the limiting member comprises two groups of first protruding surfaces disposed on two side walls spaced apart from each other along a thickness direction of the linkage bar. Each of the two groups of first protruding surfaces comprises two first protruding surfaces, and the two first protruding surfaces are spaced apart from each other to define a space-providing passage.

In a preferred embodiment, a part of each of the two pins that is disposed in the insulating housing defines a second protruding surface extending along a thickness direction of the two pins. When the limiting member is in the position-limited position, the two first protruding surfaces abut the second protruding surface along the axial direction of the two pins to define a limiting connection.

In a preferred embodiment, distal ends of the parts of the two pins that are disposed in the insulating housing extend opposite to each other to define a blocking wall. When the two pins move relative to the insulating housing, the blocking wall is electrically connected to the short-circuit protection circuit.

In a preferred embodiment, an output adapter board is disposed in the insulating housing. When the limiting member is in the position-limited position, the blocking wall is electrically connected to the output adapter board.

In a preferred embodiment, when the blocking wall is electrically connected to the short-circuit protection circuit, the blocking wall is insulated and isolated from the output adapter board.

In a preferred embodiment, the safety plug is connected to the electrical equipment body through a wire, or the safety plug is directly disposed on the electrical equipment body.

Compared with the existing techniques, the technical solution has the following advantages.

When the safety plug is pulled by an external force, the two pins are separated from the output adapter board which is disposed in the insulating housing, and an electrical equipment which is equipped with the safety plug is cut off to protect the electrical equipment. At this time, the two pins are in contact with the short-circuit protection circuit, thereby causing a short-circuit power failure, which can prevent potential danger. The most important thing is that so long as a child is pulling the safety plug, there will be a power failure in the electrical equipment, and parents can find out in time. Even if the child's finger touches the two pins or the child's finger is inserted into a socket hole when the safety plug is pulled out, as the two pins are short-circuited, the child will not receive an electric shock.

DETAILED DESCRIPTION OF THE EMBODIMENTS

Figure 1:
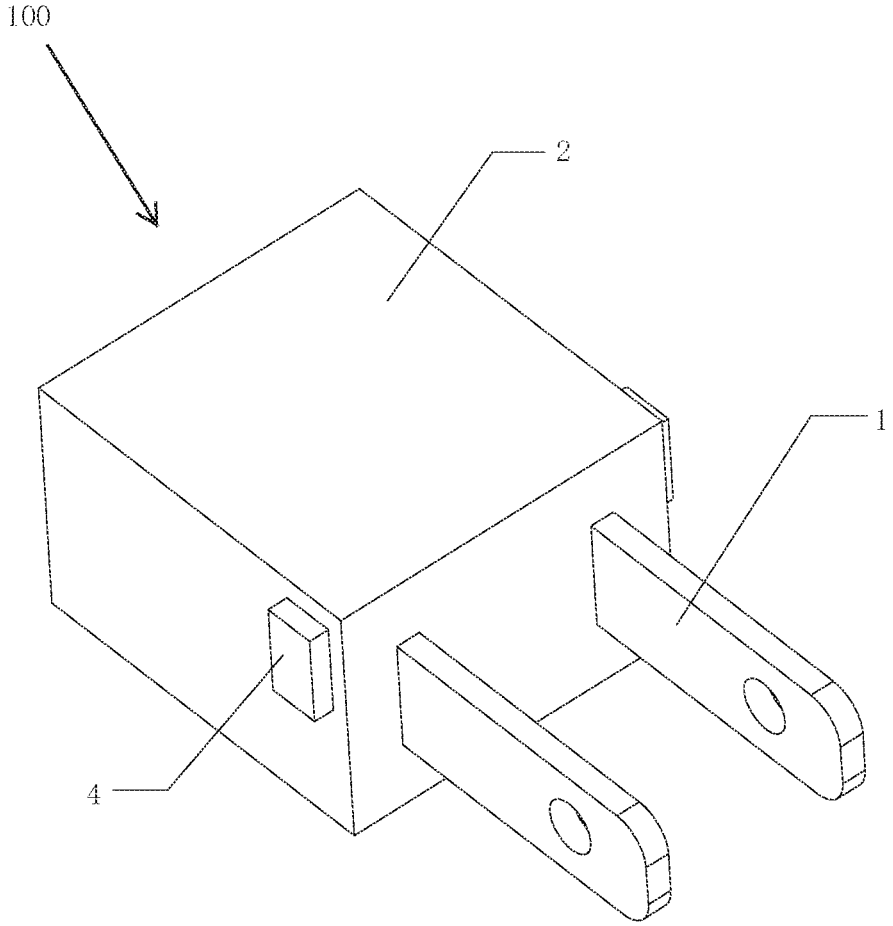
FIG. 1 illustrates a perspective view of a safety plug in a safe state in a preferred embodiment of the present disclosure.

The present disclosure will be further described below in combination with the accompanying drawings and embodiments.

The following will clearly and completely describe the technical solutions in the embodiments of the present disclosure with reference to the accompanying drawings. Obviously, the described embodiments are only a portion of the embodiments of the present disclosure, and not all of the embodiments. Based on the embodiments of the present disclosure, all other embodiments obtained by those of ordinary skill in the art without creative work fall within the protection scope of the present disclosure.

In the description of the present disclosure, it should be noted that the terms "upper", "lower", "inner", "outer", "top/bottom", etc. indicate the orientation or positional relationship based on the orientation shown in the drawings. The positional relationship is only for the convenience of describing the present disclosure and simplifying the description, rather than indicating or implying that the pointed device or element must have a specific orientation, be constructed, and be operated in a specific orientation. Therefore, the positional relationship should not be understood as a limitation of the present disclosure. In addition, the terms "first" and "second" are only used for descriptive purposes and should not be understood as indicating or implying relative importance.

In the description of the present disclosure, it should be noted that the terms "installed", "provided with", "sleeved/connected", "connected", etc., should be understood broadly. For example, "connected" can be a fixed connection, a detachable connection, or an integral connection, a mechanical connection, an electrical connection, a direct connection, or an indirect connection through an intermediate medium, and it can be a connection between two members. For those of ordinary skill in the art, the specific meaning of the above terms in the present disclosure can be understood under specific conditions.

Figure 2:
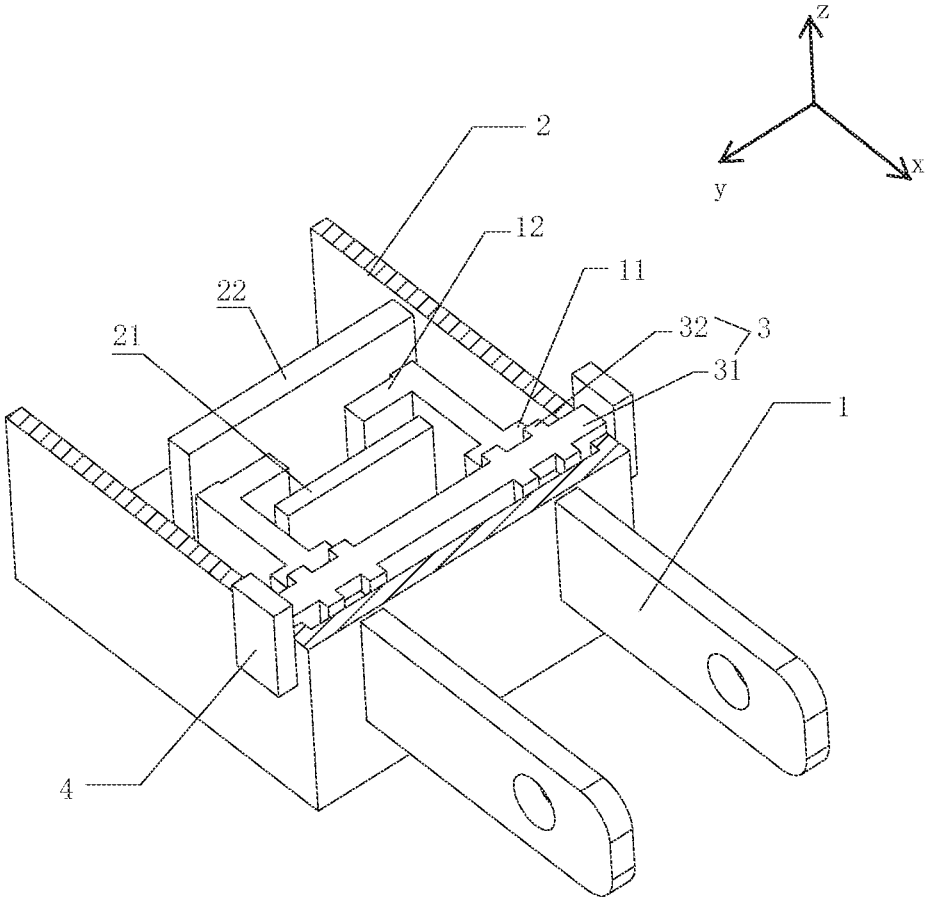
FIG. 2 illustrates a perspective view of the safety plug in the safe state with a section of an exterior of the safety plug removed.
Figure 3:
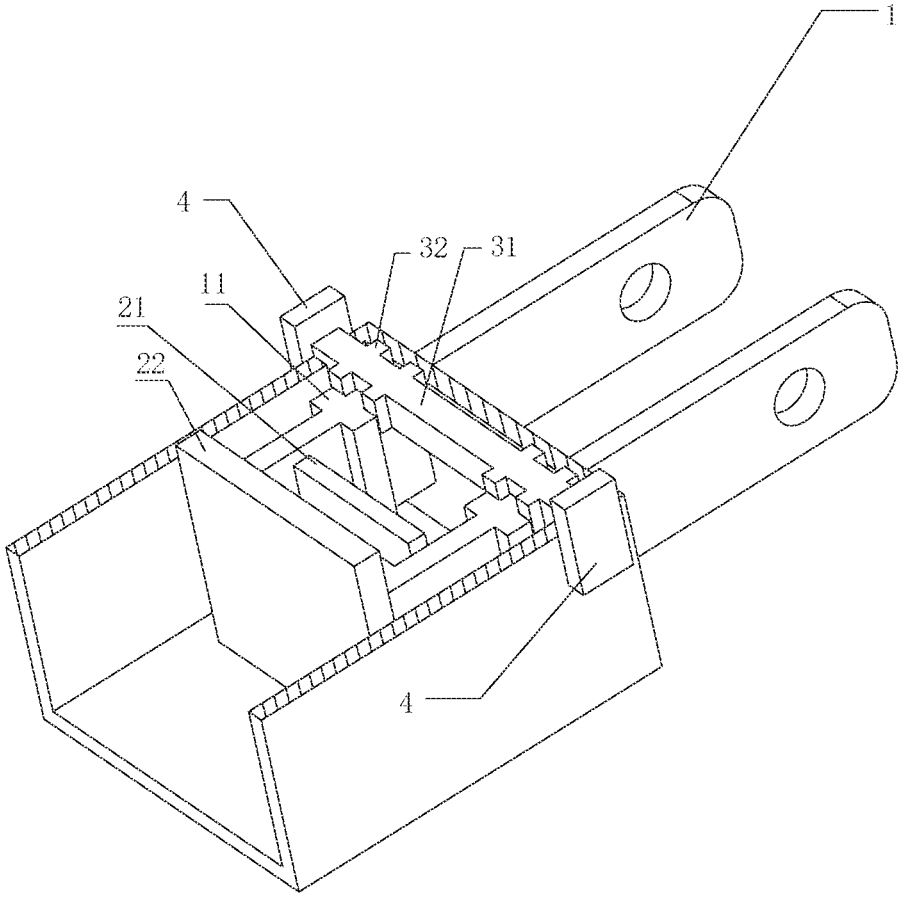
FIG. 3 illustrates another perspective view of the safety plug in the safe state with the section of the exterior of the safety plug removed.
Figure 4:
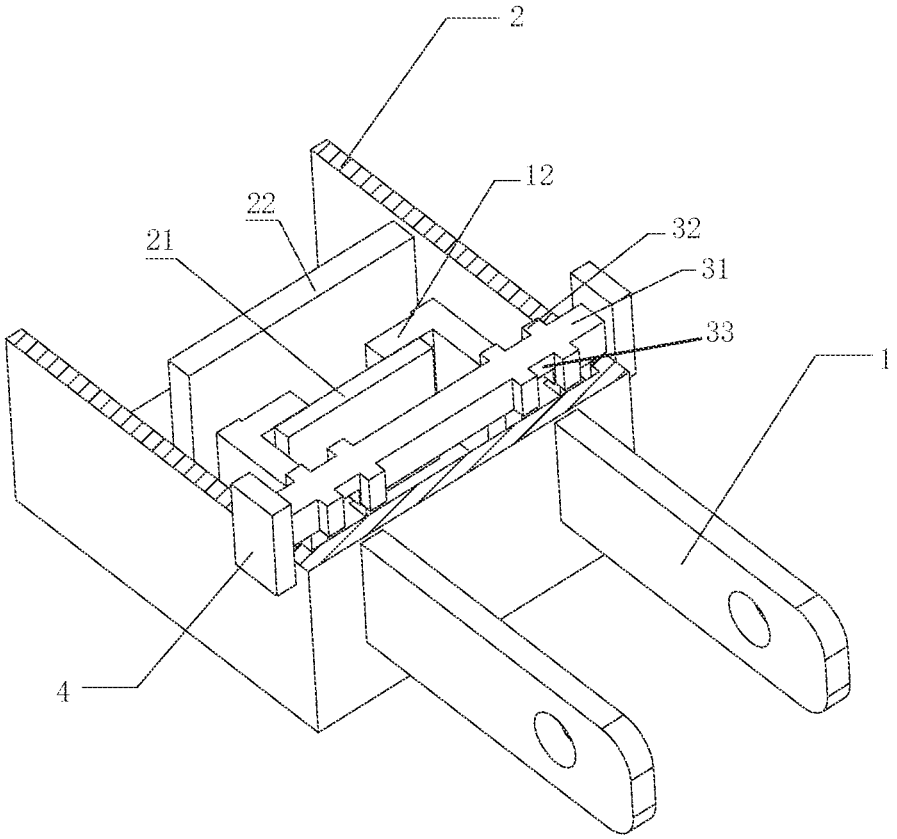
FIG. 4 illustrates a perspective view of the safety plug in a normal state with the section of the exterior of the safety plug removed.
Figure 5:
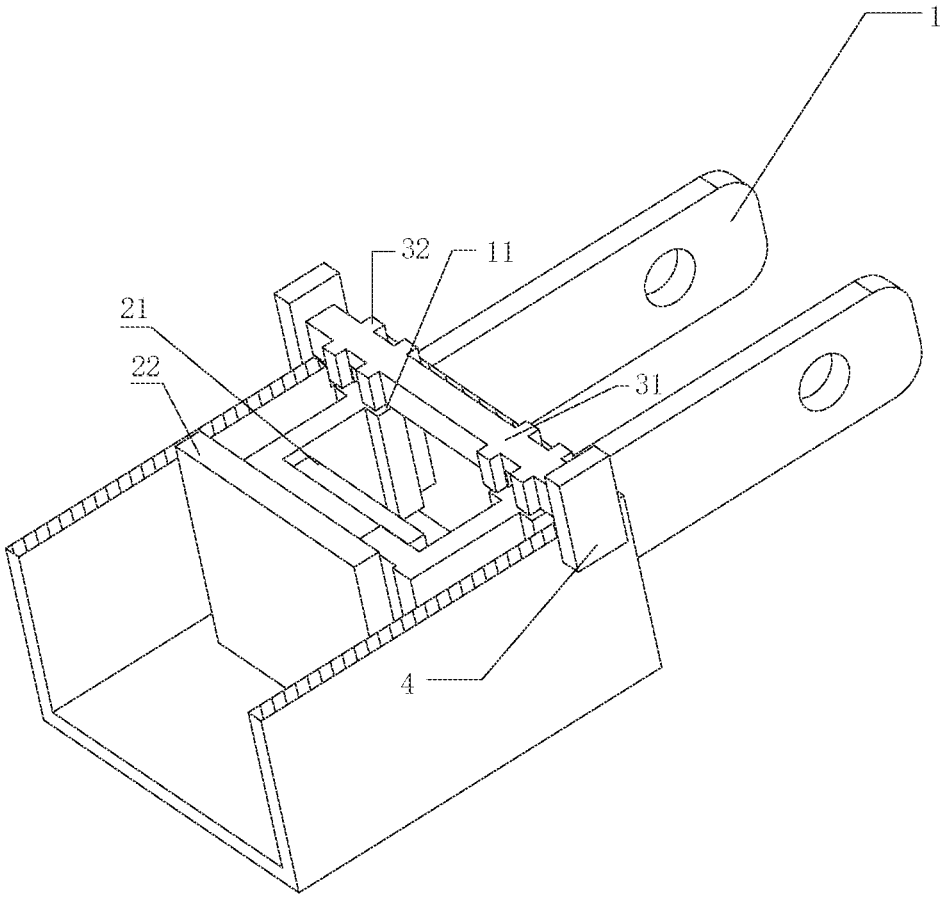
FIG. 5 illustrates another perspective view of the safety plug in the normal state with the section of the exterior of the safety plug removed.

Referring to FIG. 1 to FIG. 5, a safety plug 100 comprises two pins 1, an insulating housing 2, a limiting member 3, and an operating member 4.

The operating member 4 is configured to drive the limiting member 3 to be changed between a position-limited position and an unlocked position. When the limiting member 3 is in the position-limited position, movement of the two pins 1 and the limiting member 3 is limited in an axial direction (e.g., measured along the x-axis in FIG. 2) of the two pins 1 to define a limiting fit. When the limiting member 3 is in the unlocked position, the limiting fit is released to enable the two pins 1 and the limiting member 3 to move along the axial direction of the two pins 1.

First ends of the two pins 1 extend into the insulating housing 2, and a short-circuit protection circuit 21 is disposed in the insulating housing 2. The short-circuit protection circuit 21 is disposed in a path in which the two pins 1 move away from the insulating housing 2. When the limiting fit is defined (i.e., the limiting member 3 is in the position-limited position), the first ends of the two pins 1 are spaced apart from the short-circuit protection circuit 21. When the limiting fit is released (i.e., the limiting member 3 is in the unlocked position), the insulating housing 2 is pulled to enable the insulating housing 2 to move relative to the two pins 1 to enable the short-circuit protection circuit 21 to short circuit the two pins 1.

Therefore, in the above-mentioned safety plug 100, when the safety plug 100 is pulled by an external force, the two pins 1 are separated from an output adapter board 22, which is disposed in the insulating housing 2, and an electrical equipment which is equipped with the safety plug 100 is cut off to protect the electrical equipment. At this time, the two pins 1 are in contact with the short-circuit protection circuit 21, thereby causing a short-circuit power failure, which can prevent potential danger. The most important thing is that so long as a child is pulling the safety plug 100, there will be a power failure in the electrical equipment, and parents can find out in time. Even if the child's finger touches the two pins 1 or the child's finger is inserted into a socket hole when the safety plug 100 is pulled out, as the two pins 1 are short-circuited, the child will not receive an electric shock.

In this embodiment, the operating member 4 is disposed on both sides of the insulating housing 2 in a width direction (e.g., measured along the y-axis in FIG. 2) of the insulating housing 2 and passes through side walls of the insulating housing 2 to be operatively coupled to the limiting member 3, which makes it convenient for a user to operate the operating member 4.

The limiting member 3 comprises a linkage bar 31, which is disposed along the width direction of the insulating housing 2, and two ends of the linkage bar 31 are respectively operatively coupled to the operating member 4.

In order to enable the limiting member 3 to limit the two pins 1, the limiting member 3 comprises two groups of first protruding surfaces 32 disposed on two side walls spaced apart from each other along a thickness direction (e.g., measured along the x-axis in FIG. 2) of the linkage bar 31. Each of the two groups of first protruding surfaces 32 comprises two first protruding surfaces 32, and the two first protruding surfaces 32 are spaced apart from each other to define a space-providing passage 33.

Correspondingly, a part of each of the two pins 1 that is disposed in the insulating housing 2 defines a second protruding surface 11 extending along a thickness direction (e.g., measured along the y-axis in FIG. 2) of the two pins 1. When the limiting member 3 is in the position-limited position, two first protruding surfaces 32 abut the second protruding surface 11 along the axial direction of the two pins 1 to define a limiting connection.

In order to enable the two pins 1 to be electrically connected to the short-circuit protection circuit 21, distal ends of the parts of the two pins 1 that are disposed in the insulating housing 2 extend opposite to each other to define a blocking wall 12. When the two pins 1 move relative to the insulating housing 2, the blocking wall 12 is electrically connected to the short-circuit protection circuit 21.

In this embodiment, the output adapter board 22 (i.e., a main output adapter board) is disposed in the insulating housing 2. When the limiting member 3 is in the position-limited position, the blocking wall 12 is electrically connected to the output adapter board 22, which can ensure the normal use of the safety plug 100.

When the blocking wall 12 is electrically connected to the short-circuit protection circuit 21, the blocking wall 12 is insulated and isolated from the output adapter board 22, which can ensure that the electrical equipment is automatically powered off when the safety plug 100 is subjected to an external force.

In this embodiment, the electrical equipment comprises an electrical equipment body and the above-mentioned safety plug 100. In this embodiment, the safety plug 100 is connected to the electrical equipment body through a wire, or the safety plug 100 is directly disposed on the electrical equipment body.

It will be apparent to those skilled in the art that various modifications and variation can be made in the present disclosure without departing from the spirit or scope of the disclosure. Thus, it is intended that the present disclosure cover the modifications and variations of this disclosure provided they come within the scope of the appended claims and their equivalents.

What is claimed is:

1. A safety plug, comprising:

two pins, an insulating housing, a limiting member, and an operating member, wherein:

the operating member is configured to drive the limiting member to be changed between a position-limited position and an unlocked position, when the limiting member is in the position-limited position, movement of the two pins and the limiting member is limited in an axial direction of the two pins to define a limiting fit, when the limiting member is in the unlocked position, the limiting fit is released to enable the two pins and the limiting member to move along the axial direction of the two pins, first ends of the two pins extend into the insulating housing, a short-circuit protection circuit is disposed in the insulating housing, the short-circuit protection circuit is disposed in a path in which the two pins move away from the insulating housing, when the limiting fit is defined, the first ends of the two pins are spaced apart from the short-circuit protection circuit, and when the limiting fit is released, the insulating housing is pulled to enable the insulating housing to move relative to the two pins to enable the short-circuit protection circuit to short circuit the two pins.

2. The safety plug according claim 1, wherein:

the operating member is disposed on both sides of the insulating housing in a width direction of the insulating housing and passes through side walls of the insulating housing to be operatively coupled to the limiting member.

3. The safety plug according claim 2, wherein:

the limiting member comprises a linkage bar, which is disposed along the width direction of the insulating housing, and two ends of the linkage bar are respectively operatively coupled to the operating member.

4. The safety plug according claim 3, wherein:

the limiting member comprises two groups of first protruding surfaces disposed on two side walls spaced apart from each other along a thickness direction of the linkage bar, each of the two groups of first protruding surfaces comprises two first protruding surfaces, and the two first protruding surfaces are spaced apart from each other to define a space-providing passage.

5. The safety plug according claim 4, wherein:

a part of each of the two pins that is disposed in the insulating housing defines a second protruding surface extending along a thickness direction of the two pins, and when the limiting member is in the position-limited position, the two first protruding surfaces abut the second protruding surface along the axial direction of the two pins to define a limiting connection.

6. The safety plug according claim 5, wherein:

distal ends of the parts of the two pins that are disposed in the insulating housing extend opposite to each other to define a blocking wall, and when the two pins move relative to the insulating housing, the blocking wall is electrically connected to the short-circuit protection circuit.

7. The safety plug according claim 6, wherein:

an output adapter board is disposed in the insulating housing, and when the limiting member is in the position-limited position, the blocking wall is electrically connected to the output adapter board.

8. The safety plug according claim 7, wherein:

when the blocking wall is electrically connected to the short-circuit protection circuit, the blocking wall is insulated and isolated from the output adapter board.

9. An electrical equipment, comprising:

an electrical equipment body, and a safety plug, wherein:

the safety plug comprises two pins, an insulating housing, a limiting member, and an operating member, the operating member is configured to drive the limiting member to be changed between a position-limited position and an unlocked position, when the limiting member is in the position-limited position, movement of the two pins and the limiting member is limited in an axial direction of the two pins to define a limiting fit, when the limiting member is in the unlocked position, the limiting fit is released to enable the two pins and the limiting member to move along the axial direction of the two pins, first ends of the two pins extend into the insulating housing, a short-circuit protection circuit is disposed in the insulating housing, the short-circuit protection circuit is disposed in a path in which the two pins move away from the insulating housing, when the limiting fit is defined, the first ends of the two pins are spaced apart from the short-circuit protection circuit, and when the limiting fit is released, the insulating housing is pulled to enable the insulating housing to move relative to the two pins to enable the short-circuit protection circuit to short circuit the two pins.

10. The electrical equipment according claim 9, wherein:

the operating member is disposed on both sides of the insulating housing in a width direction of the insulating housing and passes through side walls of the insulating housing to be operatively coupled to the limiting member.

11. The electrical equipment according claim 10, wherein:

the limiting member comprises a linkage bar, which is disposed along the width direction of the insulating housing, and two ends of the linkage bar are respectively operatively coupled to the operating member.

12. The electrical equipment according claim 11, wherein:

the limiting member comprises two groups of first protruding surfaces disposed on two side walls spaced apart from each other along a thickness direction of the linkage bar, each of the two groups of first protruding surfaces comprises two first protruding surfaces, and the two first protruding surfaces are spaced apart from each other to define a space-providing passage.

13. The electrical equipment according claim 12, wherein:

a part of each of the two pins that is disposed in the insulating housing defines a second protruding surface extending along a thickness direction of the two pins, and when the limiting member is in the position-limited position, the two first protruding surfaces abut the second protruding surface along the axial direction of the two pins to define a limiting connection.

14. The electrical equipment according claim 13, wherein:

distal ends of the parts of the two pins that are disposed in the insulating housing extend opposite to each other to define a blocking wall, and when the two pins move relative to the insulating housing, the blocking wall is electrically connected to the short-circuit protection circuit.

15. The electrical equipment according claim 14, wherein:

an output adapter board is disposed in the insulating housing, and when the limiting member is in the position-limited position, the blocking wall is electrically connected to the output adapter board.

16. The electrical equipment according claim 15, wherein:

when the blocking wall is electrically connected to the short-circuit protection circuit, the blocking wall is insulated and isolated from the output adapter board.

17. The electrical equipment according claim 9, wherein:

the safety plug is connected to the electrical equipment body through a wire, or the safety plug is directly disposed on the electrical equipment body.

* * * * *